United States Patent [19]

Weder

[11] Patent Number: 4,987,831

[45] Date of Patent: Jan. 29, 1991

[54] INKING DEVICE, THE INK COAT OF WHICH IS CONTROLLABLE

[75] Inventor: Kurt Weder, Muri, Switzerland

[73] Assignee: Concepta Print AG, Gümligen, Switzerland

[21] Appl. No.: 286,955

[22] PCT Filed: Mar. 3, 1988

[86] PCT No.: PCT/CH88/00053

§ 371 Date: Nov. 2, 1988

§ 102(e) Date: Nov. 2, 1988

[87] PCT Pub. No.: WO88/06523

PCT Pub. Date: Sep. 7, 1988

[30] Foreign Application Priority Data

Mar. 3, 1987 [CH] Switzerland ..... 794/87

[51] Int. Cl.[5] ..... B41F 31/04; B41F 31/10; B41F 31/38

[52] U.S. Cl. ..... 101/350; 101/365; 101/DIG. 32; 101/DIG. 45

[58] Field of Search ..... 101/350, 365, 148, 363, 101/348, 349, 351, 352, DIG. 32, DIG. 45, 207–210

[56] References Cited

U.S. PATENT DOCUMENTS

| | | | |
|---|---|---|---|
| 3,116,688 | 1/1964 | Ward, Jr. et al. | 101/350 |
| 4,402,263 | 9/1983 | Honkawa | 101/365 |

FOREIGN PATENT DOCUMENTS

| | | | |
|---|---|---|---|
| A-0113905 | 7/1984 | European Pat. Off. . | |
| 2924635 | 1/1981 | Fed. Rep. of Germany | 101/DIG. 32 |
| 3344777 | 12/1983 | Fed. Rep. of Germany | 101/365 |
| 104259 | 3/1975 | German Democratic Rep. | 101/DIG. 32 |
| 203058 | 11/1983 | Japan | 101/365 |
| 2150081 | 6/1985 | United Kingdom | 101/DIG. 32 |

*Primary Examiner*—J. Reed Fisher

*Attorney, Agent, or Firm*—Seed and Berry

[57] ABSTRACT

A movable lifter roller (6) used for transferring the ink from an inking roller (8) to a brayer roller (5) is subdivided into a number of sections (6'). Each lifter-roller section (6') is pivoted on a respective two-armed lever (22). All levers (22) are pivotably disposed on a common axle (28) in such a way that the lifter-roller sections (6') normally rest against the brayer roller (5) and, in the activated state for picking up ink, rest against the inking roller (8). After the return into the position previously assumed, the ink picked up is transferred to the brayer roller (5). For putting the lifter-roller sections (6') into the activated state, there is associated with each individual lifter-roller section a respective electromagnet (31) which a lug (30) of the lever (22) serves as an anchor. All electromagnets 31 are rigidly fastened to a stationary support (33). Each electromagnet (31) is excited individually by means of a controller, the duration of the excitement being dependent upon the ink-density measured value belonging to the respective area. With the inking device thus designed, existing inking devices can be used, it merely being necessary to exchange the inkwell for changing the ink.

3 Claims, 3 Drawing Sheets

INKING DEVICE, THE INK COAT OF WHICH IS CONTROLLABLE

Figure 1:
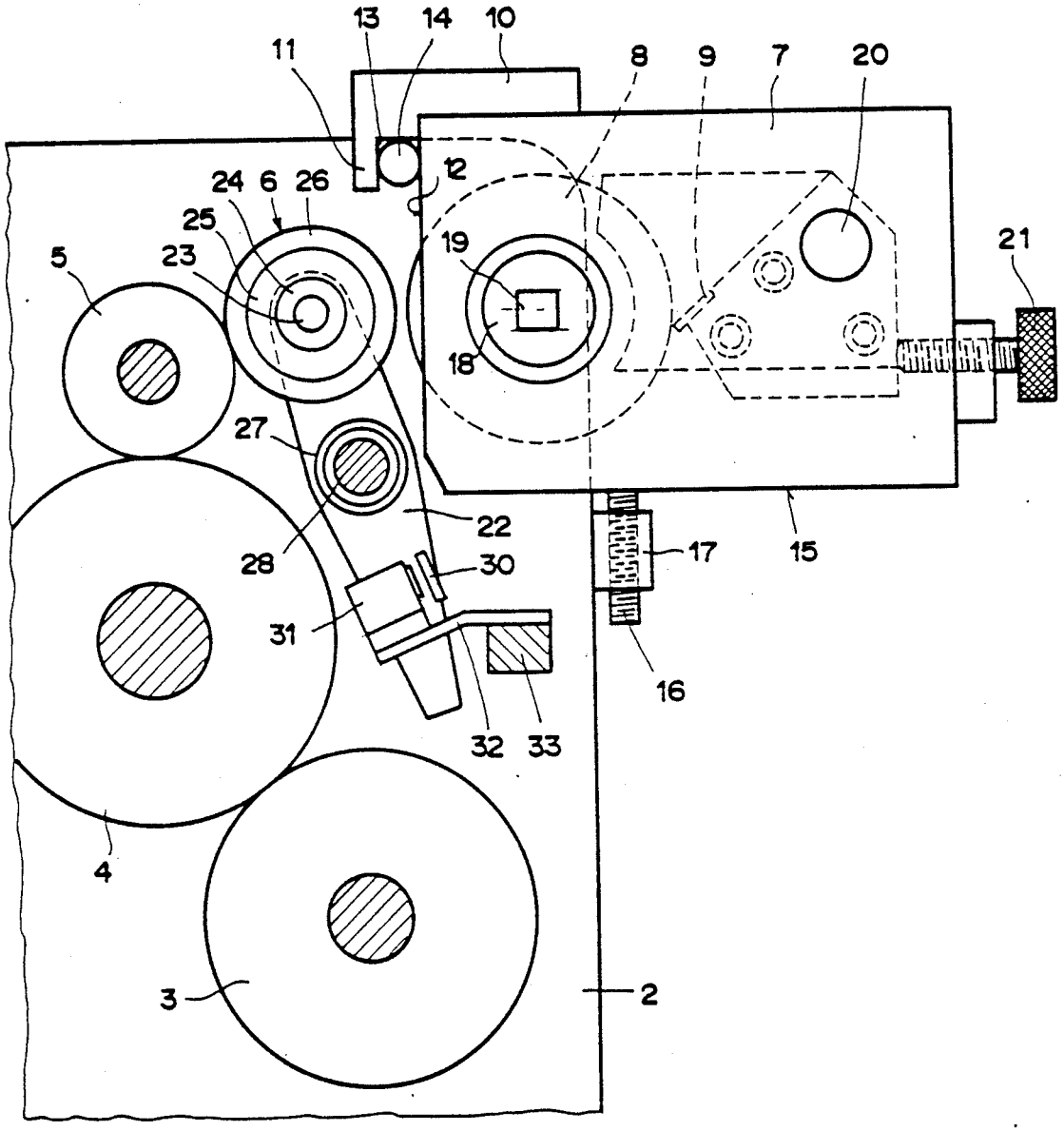

The invention relates to an inking device according to the generic clause of patent claim 1.

In the European patent specification having the publication number 113 905, a process for adjusting the the inking in an inkwell is described. The known inkwell has an inking roller and a doctor blade co-operating with the latter, subdivided into individual sections. Associated with each doctor-blade section is a setscrew and an angle piece actuatable by the latter for varying the spacing between the end of the doctor-blade and the inking roller. By actuating the setscrews, the thickness of the coat of ink on the inking roller and thus the ink density on the sheet of paper printed on can be adjusted section-wise. For proofing machines, it is advantageous if, for changing the ink, only the inkwell with the inking roller and the doctor blade is interchanged. In the known inking device, it is desirable to improve the accuracy of adjustment of the inking.

It is the task of the invention to provide an inking device in which the inking is very finely controllable.

The inking device according to the invention is characterized by the features recited in the characterizing clause of patent claim 1.

The subject of the invention is explained in more detail below, by way of example, with reference to the drawing.

Figure 2:
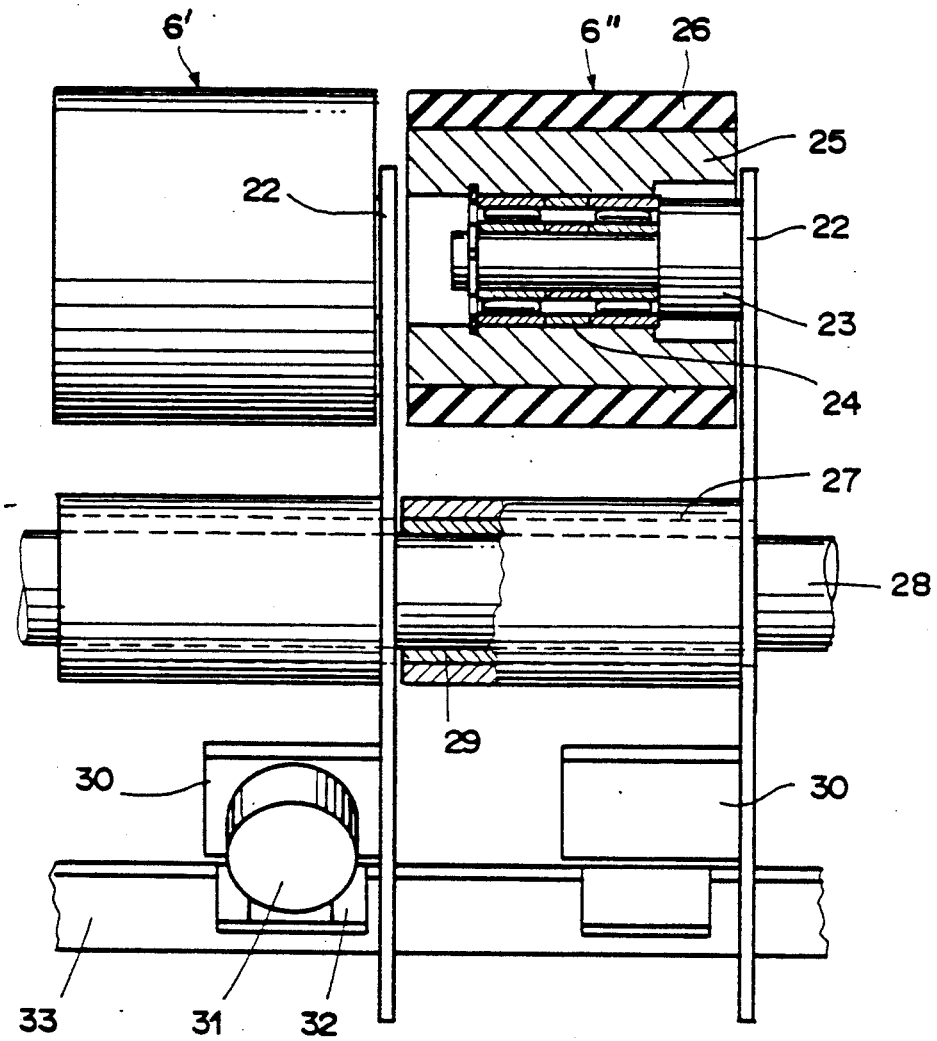
Figure 3:
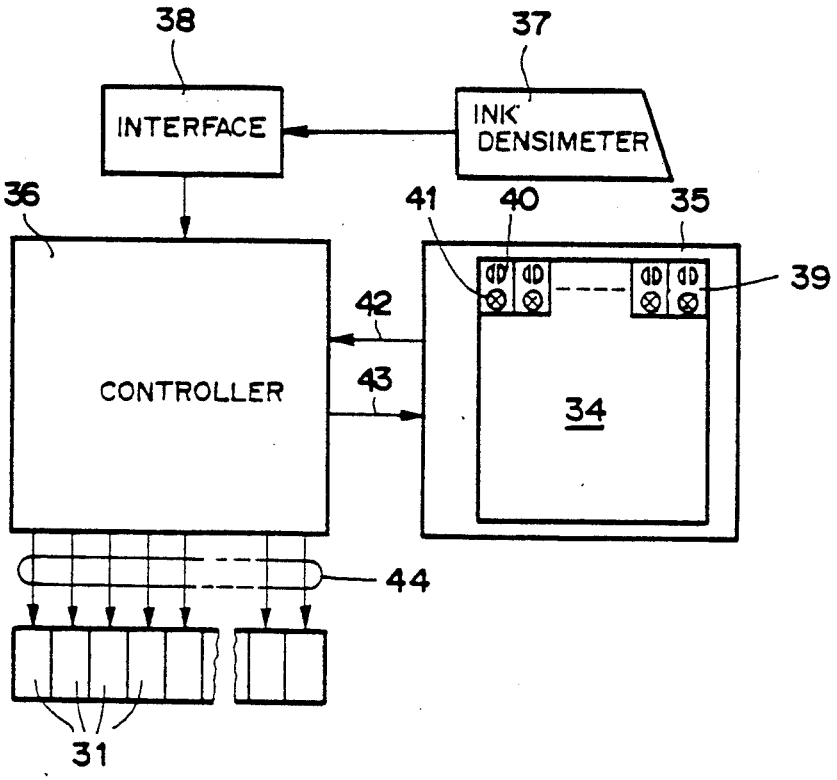

FIG. 1 shows a cross-section through an exemplified embodiment of the inking device according to the invention, the sectional plane being situated between the non-depicted sidewall and the inking device, FIG. 2 shows part of a lifter roller of the inking device according to FIG. 1, and FIG. 3 shows the block diagram of an installation for measuring and adjusting the ink-density values of a printed sheet.

FIG. 1 shows the cross-section of a corner region of an inking device 1 of a flat-bed proofing press of which inking device only the one sidewall 2 is visible. The inking device 1 comprises an application roller 3, a pre-roller 4, a brayer roller 5, a lifter roller 6, and an inkwell 7. Disposed in the inkwell 7 are, rotatably, an inking roller 8 and, adjustably, a doctor blade 9. Fastened on the top of the inkwell 7 is an angle piece 10, the angular end 11 of which forms with the adjacent wall 12 of the inkwell 7 a groove 13 which is open downward. Between the sidewall 2 visible in FIG. 1 and the non-visible sidewall of the inking device 1 extends a rod 14. The inkwell 7 is inserted in the inking device 1 in such a way that the rod 14 is situated in the groove 13. The bottom 15 of the inkwell 7 is supported on at least two setscrews 16 which are screwed into lugs 17 of the inkwell 1 [sic].

For driving the inking roller 8, there is in an end face of the shaft 18 a recess 19 of square cross-section into which is insertable a square end on an axially displaceable and non-drawn drive shaft, mounted in the non-depicted sidewall of the inkwell 1 [sic], of a motor.

The doctor blade 9 pivotable about a shaft 20 can be shifted by means of several setscrews 21 for adjusting the inking.

The inking roller 8 is driven counterclockwise relative to FIG. 1. Only the lower part of the inking roller 8 dips a little into the nondepicted ink. By means of the doctor blade 9, the thickness of the coat of ink picked up by the inking roller 8 is regulated.

The lifter roller 6 is subdivided in its length into a number of sections, e.g., twenty. Each of the sections 6′ and 6″, two of which are depicted in FIG. 2, is pivoted on a two-armed lever 22. For this purpose, a necked-down bolt 23 is fastened to each of the levers 22. Placed on the necked-down portion of the bolt 23 is a roller bearing 24 which bears a bushing 25. The surface of the bushing 25 is covered with an elastic layer 26, preferably of rubber, for forming the section 6′ or 6″ of the lever roller.

Each lever 22 has, about in the middle, a recess to the margin of which a bearing bush 27 is fastened. Through all the bearing bushes 27 there extends a common axle 28 about which the levers 22 are pivotable independently of one another. The bearing bushes 27 may, for example, be sliding sleeves which have a lining 29 of a beryllium-copper alloy. The bearing bushes 27 serve simultaneously as spacers between adjacent levers 22.

Disposed on each lever 22, on each lever arm opposite the lifter-roller section 6′ or 6″, is a lug 30 of ferromagnetic material. The lug 30 serves as an anchor for an electromagnet 31. The electromagnets 31 are rigidly connected by means of one angular support each to a supporting bar 33 of rectangular cross-section. The supporting bar 33 is fastened at its ends to the sidewall 2 and to the non-depicted sidewall of the inking device 1.

From FIG. 1 it is apparent that when the electromagnet 31 is excited in a manner described below, that the lug 30 is attracted by the electromagnet 31, and the lever 22 is pivoted clockwise, relative to FIG. 1. As a result, the lifter-roller section 6′ or 6″ associated with the lever 22 lifts off the brayer roller 5 and, for raising ink from the inking roller 8, is moved toward the latter. If the electromagnet 31 is de-energized again, the lever 22 is swivelled counterclockwise by the gravity acting upon it and the accompanying lifter-roller section 6′ or 6″, the ink previously raised from the inking roller 8 by the lifter-roller section 6′ or 6″ being transferred to the brayer roller 5.

The quantity of ink transferred by the lifter-roller sections 6′ or 6″ from the inking roller 8 to the brayer roller 5 is dependent upon the speed of rotation of the inking roller 8 and of the lifter-roller section, as well as of the time during which the electromagnet 31 is excited. The maximum period during which the electromagnet 31 is excited corresponds to the duration of one revolution of the respective lifter-roller section 6′ or 6″. If the electromagnet 31 is excited during the whole said period, the whole outside surface of the lifter-roller section 6′ or 6″ picks up ink from the inking roller 8, and the maximum quantity of ink is transferred to the brayer roller 5.

If, for example, only half the quantity of ink is needed in the region of one of the lifter-roller sections, the electromagnet 31 of the respective lifter-roller section 6′ or 6″ is excited only during half of the said period and consequently only half the surface of this lifter-roller section picks up ink from the inking roller 8, and accordingly only half the quantity of ink is transferred to the brayer roller 5. By changing the time during which the electromagnet 31 is excited, any intermediate value of ink quantity between zero and maximum can be transferred from the inking roller 8 to the brayer roller 5.

If, by way of exception, this maximum value should not suffice, the doctor blade 9 of the respective zone can be so adjusted by means of the setscrew 21 that the coat of ink on the inking roller 8 becomes thicker.

Instead of the two-armed lever 22, a one-armed lever may also be used, the electromagnet 31 then having to be disposed on the other side of the lug 30 serving as an anchor. Moreover, it is conceivable that there be used, instead of the electromagnet 31, an electric motor which drives an eccentric disk that acts directly upon the lug 30. Further, there may be provided a non-depicted spring which moves the lever 22 into its resting position, in which the lifter-roller sections 6' or 6'' rest against the brayer roller 5, when the electromagnet 31 is not excited.

FIG. 3 shows the block diagram of an installation for measuring and adjusting the ink-density values of a printed sheet 34 which is situated on a measuring space 35. Besides the measuring space 35, this installation comprises a controller 36, an ink densimeter 37 which is connected across an interface 38 to the control unit 36, and, disposed on the measuring space 35, measuring-section fields 39, each of which has a lightemitting diode 40 and a push-button 41.

By means of the measuring-section fields 39, for example twenty in number, the printed sheet is subdivided into a number of sections, which sections correspond to the lifter-roller sections 6' or 6''. The ink-density measured values measured by means of the ink densimeter 37 at the areas of the printed sheet indicated by the measuring-section fields 39 reach the controller 36 via the interface 38. In order that the controller 36 may recognize to which measuring-section field 39 the received ink-density measured value belongs, this is reported over conductor 42 to the controller 36 by actuation of the push-button 41. When the received ink-density measured value is stored at the correct location, the associated light-emitting diode 40 controlled over conductor 43 lights up, and the ink density is then carried out in the following measuring-section field 39. As already mentioned, the ink-density measured values determined are stored in a non-depicted memory of the controller 36 until a new measuring series is carried out. The winding of each of the twenty electromagnets 31 is connected over a conductor of bunched conductors 44 to a non-depicted converter in the controller 36. Each of these converters generates a control pulse for exciting the associated electromagnet 31, the duration of the control pulse being dependent upon the respective stored ink-density measured value. If, for example, the ink-density measured value is small comparatively with an average value, the duration of the control pulse is increased. As a result, the electromagnet 31 remains excited longer, the accompanying lifter-roller section 6' or 6'' rests longer against the inking roller 8 and picks up more ink, whereby after de-energizing of the electromagnet 31 a larger quantity of ink is transferred to the brayer roller 5.

In the above-described inking device, inking can be regulated automatically as a function of the measured ink density, and all the same it is possible in the case of a flat-bed proofing press to interchange the inkwell 15 [sic]including the inking roller 8 in a simple manner and quickly for changing the printing ink. For this purpose, no modifications on the inkwell are necessary, but previously known inkwells may be used without modification.

The above-described lifter roller 6 subdivided into sections can be just as advantageously used in an impression printing machine in which the inkwell is a fixed component of the printing machine. In this case, this has a favorable effect in a more exact dosing of the ink coat.

What is claimed is:

1. An inking device for controllable and interchangeable inking comprising:

an ink densimeter (37) measuring and adjusting ink-density values of a printed sheet;

a controller (36) storing the measured ink-density values;

an interface (38) operatively connecting the ink densimeter to the controller;

a brayer roller (5) rotatably mounted in the inking device;

an inking roller (8) drivably mounted in an inkwell unit;

a lifter roller (6) comprising a plurality of roller sections (6', 6''), each roller section being independently moveable transversely in a longitudinal direction between the inking roller and the brayer roller;

a plurality of actuation means (30, 31) each associated with a corresponding roller section for actuating the roller sections into reciprocative engagement between the brayer roller and the inking roller;

means (44) operatively connected to the actuation means for causing the controller to actuate each of the actuation means individually for a period of time determined as a function of said ink-density values measured on the printed sheet; and the inkwell unit selectively removable from the remainder of the inking device, the inkwell unit having an angle piece (10) extending from the top of the inkwell unit, the angle piece having a downwardly facing groove (13) sized to receive therein a corresponding support rod (14) attached to the remainder of the inking device so that the inkwell unit is supported by and detachable from the remainder of the inking device, the inkwell unit comprising an inkwell holding ink and a doctor blade mounted in the inkwell and engaging the inking roller and regulating the amount of ink taken by the inking roller from the inkwell, the inking roller being mounted in the inkwell unit such that the inkwell unit surrounds the doctor blade and the inking roller and the inkwell unit is interchangeable as a complete unit when changing ink.

2. The inking device of claim 1, further comprising an axle (28) and a plurality of levers (22) pivotally mounted on said axle, the axle extending through a middle portion of each lever, each of said roller sections being pivoted on one of said levers.

3. The inking device of claim 2, wherein each of said actuation means (31) comprises an electromagnet and each of said levers (22) includes a lug (30) coupled to the lever opposite the roller section and serving as an anchor for an associated one of said electromagnets.

* * * * *